United States Patent [19]

Kawabata

[11] Patent Number: 4,547,864

[45] Date of Patent: Oct. 15, 1985

[54] CORRELATION DETECTING DEVICE

[75] Inventor: Takashi Kawabata, Kanagawa, Japan

[73] Assignee: Canon Kabushiki Kaisha, Tokyo, Japan

[21] Appl. No.: 452,876

[22] Filed: Dec. 27, 1982

[30] Foreign Application Priority Data

Jan. 7, 1982 [JP] Japan ..... 57-1490

[51] Int. Cl.[4] ..... G06G 7/19; G06J 1/00

[52] U.S. Cl. ..... 364/824; 364/822; 364/604; 382/42

[58] Field of Search ..... 364/819, 822, 824, 604, 364/728; 382/42; 354/408, 403

[56] References Cited

U.S. PATENT DOCUMENTS 3,961,171 6/1976 Freeman ..... 364/728

4,004,852 1/1977 Pentecost ..... 356/1

4,161,033 7/1979 Martinson ..... 364/728

4,329,033 5/1982 Masunaga et al. ..... 354/408

4,400,790 8/1983 Chambers et al. ..... 364/819

*Primary Examiner*—Joseph Ruggiero

*Attorney, Agent, or Firm*—Toren, McGeady, Stanger, Goldberg & Kiel

[57] ABSTRACT

The present invention relates to a correlation detecting device which has an analog shift register consisting of a pair of minor loops, a difference detection circuit to form signals for difference between corresponding bits thereof, and a major analog shift register to add differential outputs within a 1 minor-loop and to make 1 bit out of the same, and is so made that the maximum correlation is to be detected by bits having the minimum values out of the bits of the major analog shift register.

18 Claims, 1 Drawing Figure

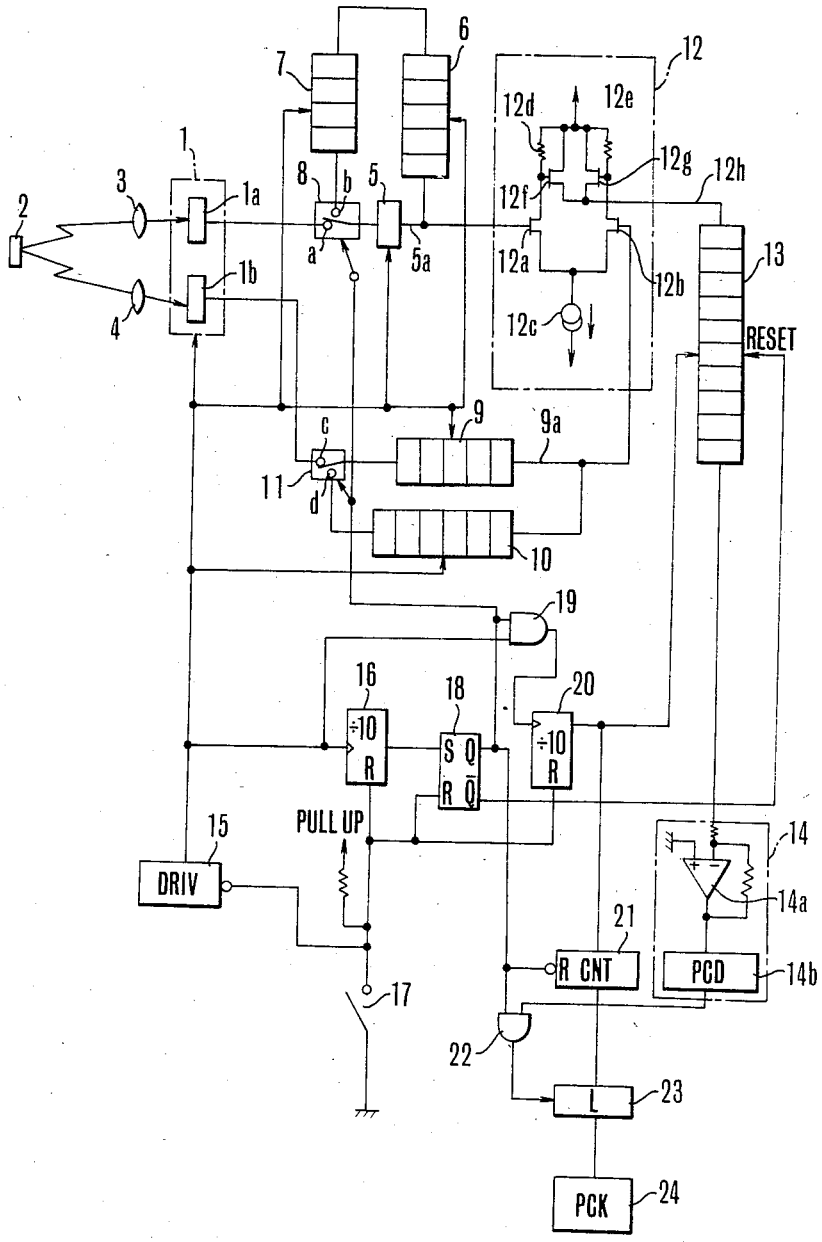
1
1a
1b
2
3
4
5
5a
6
7
8
a
b
9
9a
10
11
c
d
12
12a
12b
12c
12d
12e
12f
12g
12h
13
RESET
14
14a
14b
PCD
15
DRIV
16
÷10
R
17
18
S Q
R Q̄
19
20
÷10
R
21
R CNT
22
23
L
24
PCK
PULL UP

CORRELATION DETECTING DEVICE

BACKGROUND OF THE INVENTION

1. Field of the Invention:

The present invention relates to a correlation detecting device to detect a correlation of two images.

2. Description of the Prior Art:

Heretofore, as an automatic focus detection device, there has been a device to have images of an object introduced through two different optical paths for detecting an in-focus position out of an amount of deviation in two images thereof. In this case, a correlation detecting device to detect correlation between the two images will become necessary. However, since image signals thereof are analog signals, they are very susceptible to a damage by a transfer, etc., therefore, a number of registers to retain said analog signals need to be provided, which constitute shortcomings of complicating circuits and making sizes thereof larger. Thus, this type of correlation detecting device has A/D converted such analog signals and then processed the same.

However, such device needs to have circuits to make a high speed A/D conversion and a high speed digital operations, resulting in such shortcomings as an increased cost of circuits and increased technical difficulties.

SUMMARY OF THE INVENTION

It is an object of the present invention to provide a correlation detecting device, which has a pair of analog shift registers forming a closed loop, shift means to have a correspondence between each bit in said analog shift registers shifted every time said analog shift registers make one cycle of circulation, and operation means to add differences between signals of corresponding bits of said analog shift registers for every 1 loop of the analog shift registers thus making correlation signals of images, so that image signals can be processed in their form of analog signals themselves and correlation can be detected therefrom by a very simple circuit arrangement.

Other objects of the present invention shall be made clear by a concrete example of the invention shown below.

BRIEF DESCRIPTION OF THE DRAWING

The drawing is a circuit diagram of a correlation detecting device to show an example of the present invention.

DETAILED DESCRIPTION OF THE PREFERRED EMBODIMENT

Now, an example of the present invention shall be explained based on the drawing. The drawing is to show a circuit arrangement of a correlation detecting device as it is used in an automatic focus detection device which has images of an object introduced through two different optical paths and detects an in-focus position out of deviation of these two images, that is a correlation of the two images.

In this drawing, 1 is a light receiving part having a pair of line sensors 1*a*, 1*b*, wherein the line sensors 1*a*, 1*b* receive light beams reflected from an object 2 separately through different optical paths 3, 4. That is, since a correlation of positions of images received by the line sensors 1*a*, 1*b* varies depending on a perspective of the object 2, a detection of a distance to the object 2 or a detection of an in-focus position of a lens can be made based on the same. What is shown as 5 is an analog shift register with 1-bit, and 6 is an analog shift register with 5-bits, while 7 is the same with 4-bits, and CCD, etc. are used therefor, wherein these analog shift registers 5, 6, 7 form a closed loop analog shift register with 10 bits through a change-over switch 8 such as an electronic switch, etc. That is, when the switch 8 is at "a" side, the analog shift register 5 receives image signals, time sequential image signals of 10 bits for example, from the line sensor 1*a* introduced thereinto and transfers the same in turn to the analog shift registers 6, 7, and when the switch 8 is changed over to "b" side, the input of the image signals from the line sensor 1*a* is discontinued, and an output terminal of the analog shift register 7 and an input terminal of the analog shift register 5 are connected together, thus the analog shift registers 5, 6, 7 form a closed loop, then input image signals circulate one bit by one bit in synchronism with clock signals from a driving circuit 15 to be described later. What is shown as 9 is an analog shift register with 5 bits and 10 is an analog shift register with 6-bits, and CCD, etc. are used in such registers, forming analog shift registers of a closed loop with 11-bits through a change-over switch 11 such as an electronic switch, etc. And when the switch 11 is at "c" side, image signals, time sequential image signals of 10 bits for example, from the line sensor 1*b* are introduced into the analog shift register 9 and are transferred in turn, but when the switch 11 is changed over to "d" side, the analog shift registers 9, 10 form a closed loop, and input image signals are circulated in synchronism with clock signals from the driving circuit 15. What is shown as 12 is a differential circuit to detect a difference between an output 5*a* of the analog shift register 5 and an output 9*a* of the analog shift register 9, wherein said outputs 5*a*, 9*a* are received respectively by field effect transistors 12*a*, 12*b*, and differential voltages will be generated at resistors 12*d*, 12*e* by a constant current circuit 12*c*. These differential voltages have current converted by field effect transistors 12*f*, 12*g*, thereby producing differential signals at a terminal 12*h*. This differential circuit 12 may be any circuit such as a known type of an absolute differential amplifier, etc., as long as absolute value signals can be obtained. What is shown as 13 is an analog shift register with 11-bits which shifts one bit by one bit every time the shift registers 5, 6, 7 make one cycle of circulation while adding an output of the differential circuit 12.

That is, since the shift registers 5, 6, 7 form a closed loop with 10-bits and the shift registers 9, 10 form a closed loop with 11-bits, corresponding bits being introduced into the differential circuit 12 of the shift registers 5, 6, 7 and those of the shift registers 9, 10 will be shifted by one bit by one bit every time the shift registers 5, 6, 7 make one cycle of circulation. Therefore, the signals input into one bit of the shift register 13 represents the difference in the total image signals received by the line sensors 1*a*, 1*b*, thus corresponding image signals take values of difference of shifted images one by one. What is shown as 14 is a minimum value detecting circuit consisting of an inversion amplifier 14*a* and a peak value detecting circuit 14*b*, to detect the minimum value out of each bit of the shift register 13. What is shown as 15 is the driving circuit which generates clock signals by a closing of a switch 17 to control the light receiving part 1, the shift registers 5, 6, 7 and the shift registers 9, 10 in synchronism with said clock signals.

What is shown as 16 is a decimal frequency divider which receives signals from the driving circuit 15 as an input thereinto, and a resetting thereof is released by a closing of the switch 17. What is shown as 18 is an RS-flip-flop, which has its resetting released by a closing of the switch 17 and has its Q-output changed to a high level when signals at high level are introduced from the decimal frequency divider 16 into a terminal S, then the switch 8 is changed over to "b" side and the shift registers 5, 6, 7 are formed into a closed loop and at the same time the switch 11 is changed over to "d" side, and the shift registers 9, 10 are made to form a closed loop. Also at the same time $\overline{Q}$ output of the RS-flip-flop is changed to a low level to release a resetting of the shift register 13. What is shown as 19 is an AND gate to produce the clock signals of the driving circuit 15 as its output when Q output of the RS-flip-flop is introduced as an input with a high level. What is shown as 20 is a decimal frequency divider, which has its resetting released when the switch 17 is closed to have signals of the AND gate 19 introduced thereinto. What is shown as 21 is a counter, which has its resetting released when the Q output of the RS-flip-flop is changed to a high level to count the clock signals having a frequency thereof divided into 10 from the decimal frequency divider 20. What is shown as 22 is an AND gate, and when the minimum value detecting circuit detects the minimum value of the shift resistor 13 under a state in which the Q output of the RS-flip-flop is at a high level, a latch circuit 23 is actuated by signals thereof and signals of the counter 21 at that time is latched, for detecting a position of the maximum correlation. What is shown as 24 is processing circuit which detects a distance to an object and an in-focus position of a lens from a display of a correlation based on signals from the latch circuit 23 and from the fact that a perspective of the object corresponds to the position of the maximum correlation.

Next, operations of the above-mentioned arrangement shall be explained.

When the switch 17 is at an open state as shown in the drawing, each part of the circuit is in a reset state, and clock signals are not generated from the driving circuit 15. Therefore Q outputs of the RS-flip-flop are at a low level, and the changeover switches 8, 11 are connected to respectively "a" side and "c" side, while the analog shift registers 5, 6, 7 as well as the analog shift registers 9, 10 are in a state being connected to the light receiving part 1.

When the switch 17 is closed from said state, the reset state of each part in the circuit except the shift register 13 and the counter 21 is released and at the same time the driving circuit 15 starts an operation, then clock signals are given to the light receiving part 1, and the shift registers 5, 6, 7 as well as to the shift registers 9, 10. Therefore, in synchronism with said clock signals the image signals received by the line sensor 1*a* are transferred in turn from the shift register 5 to the shift registers 6, 7 and at the same time image signals, time sequential image signals of 10 bits for example, received by the line sensor 1*b* are transferred in turn from the shift register 9 to the shift register 10.

When 10 clock signals are generated from the driving circuit 15, signals with a high level from the decimal frequency divider 16 are introduced into "S" input terminal of the flip-flop 18, and the Q output of the RS-flip-flop 18 which has been in a low level up to this moment is changed to a high level. By this, the changeover switches 8, 11 are changed over to "b" side and "d" side respectively and the input of the image signals from the light receiving part 1 into the shift registers 5, 9 is cut off, and at the same time the shift registers 5, 6, 7 as well as the shift registers 9, 10 form closed loops, respectively. At the same time the $\overline{Q}$ output of the RS-flip-flop 18 becomes to have a low level, therefore a resetting of the shift register 13 is released. Therefore, the difference between corresponding bits of the shift registers 5, 6, 7 and of the shift registers 9, 10 which respectively form closed loops, that is starting with a value of the shift register 5 at a time when 10 clocks much of the clock signals from the driving circuit 15 are generated (a tenth image signal from the line sensor 1*a*) and a value of an output bit of the shift register 9 (6th image signal from the line sensor 1*b*) are operated by the differential circuit 12, then results thereof will be added to the first bit of the shift register 13. On the other hand, the Q outputs of the RS-flip-flop give signals of high level to an input terminal at one side of the AND gate 19, therefore the clock signals of the driving circuit 15 will be given also to the decimal frequency divider 20 through the AND gate 19. Therefore, signals of ten clocks are sent from the driving circuit 15, then as the operated outputs of the difference between each bit of the shift registers 5, 6, 7 as well as of the shift registers 9, 10 forming a closed loop respectively make one cycle of circulation around said closed loops, high level signals are produced out of the decimal frequency divider 20 and the shift register 13 is shifted by one bit. Since a number of corresponding bits of the shift registers 5, 6, 7 and that of the shift registers 9, 10 are different by one, when one cycle of circulation is made as mentioned above, the corresponding bits of the shift registers 5, 6, 7 and that of the shift registers 9, 10 will be deviated by one bit each because of a closed loop. Since the clock signals from the driving circuit 15 having the frequency thereof divided by ten are introduced into the shift register 13 as an input, a sum of the absolute values of difference between the corresponding bits, being deviated by one bit each, of the shift registers 5, 6, 7 and of the shift registers 9, 10 for every one cycle will be retained in turn at each bit of the shift register 13. That is, while the shift registers 5, 6, 7 and the shift registers 9, 10 are minor loop shift registers, the shift register 13 is a major shift register, and while the shift registers 5, 6, 7 and the shift registers 9, 10 make one cycle of circulation with 10 clocks of the clock signals of the driving circuit 15, the shift register 13 is shifted by one bit with 11 clocks of the clock signals. Thus, when the shift register 13 makes shiftings by 11 bits, the absolute value of difference between image signals of the shift registers 5, 6, 7 being shifted by 10 bits and those of the shift registers 9, 10 also being shifted by 10 bits can be obtained. That is, the signal Qi at a number i bit from the input terminal of the shift register 13 will be equivalent to $$Qi = \sum_{j=1}^{10} |A_{6-i+j} - B_{9+j}|$$

if the signals at a number j from the input terminals of the shift registers 5, 6, 7 and the shift registers 9, 10 are represented by Bj, Aj, respectively.

The Q output of the RS-flip-flop releases a resetting of the counter 21, and the counter 21 counts the clock signals having been produced from the decimal frequency divider 20 and having their frequency divided by ten. Since the operation of the shift register 13 also synchronizes with said signals having their frequency divided by ten as mentioned above, when signals of each bit of the shift register 13 are introduced into the minimum value detecting circuit 14 and the minimum value is detected, the latch circuit 23 is actuated through the AND gate 22 which is at an actuated state by the Q output of the RS-flip-flop 18, and the counted value of the counter 21 at that time will be latched. That is, the minimum value of the absolute difference of the image signals shows the maximum correlation, therefore a bit position of the shift register 13 holding said value, that is an amount of shifting until the maximum correlation will be obtained from a number of counting by the counter 21 and will be latched in the latch circuit 23. The signals being latched by the latch circuit 23 are sent to the processing circuit 24, and such operations as a display, a range finding, an in-focus detection, etc. will be done.

If CCD and the like are of MOS process type used as the light receiving member in the above example, the light receiving portion can also serve as an analog shift register. Also the switches 4, 8, 11 can be actuated by the opening and closing operation of the transfer gate in CCD, and the summation input can be performed by giving charges to CCD so that it is possible to design a very small correlation detection circuit free from waste.

Also, similar effect can be obtained even if, the major shift registers, etc. are replaced with such bipolar as BBD, etc. as an example, or even if the major shift register is made to have the minimum value memory (including an address).

As has been explained above, by making minor loops of analog shift registers in the manner mentioned above, a correlation detecting device with a simple analog circuit arrangement not requiring almost any external circuits can be realized, especially since an analog processing of image signals can be made mainly with one chip by including such circuit as mentioned above within a sensor, the circuit arrangement can be made small and a cost therefor can be reduced, so that it will be very useful as a correlation detecting device in an image correlation or in a pattern matching, etc.

Also a device of the present invention can naturally be used in all cases in which a detection of correlation is needed.

What I claim:

1. An image signal processing device used in an image correlation detecting device comprising:

first and second analog shift registers for respectively retaining and shifting signals as an image of an object, said first and second analog shift registers forming respectively closed loops to shift signals in successive cycles, the signals in the bits in the first analog shift register and that in the second analog shift register being arranged to be offset relative to each other;

comparison means for comparing said signals of the image for every corresponding bit of the first and second analog shift registers and producing a comparison value as an output;

one of said shift registers including stepping means for shifting the signals in the bits said first and second analog shift registers relative to each other so as to vary the relationships between corresponding bits for every cycle of the analog shift registers; and adder means for adding outputs of said comparison means, said adder means making the addition for every 1 loop of the analog shift registers and producing a result of said addition as a correlation signal.

2. An image signal processing device according to claim 1, in which said step means makes the number of stages of analog shift registers in the first loop different from the other loop.

3. An image signal processing device according to claim 2, in which the comparison means contains a difference detection circuit to detect a difference between the corresponding bits.

4. An image signal processing device according to claim 3, in which the adder means contains an analog register or analog registers.

5. An image signal processing device according to claim 4, in which the analog shift registers are made of CCD's.

6. A correlation detecting device for detecting a correlation of an image, comprising:

first and second signal receiving means to receive image signals;

first and second analog shift registers to respectively retain and shift image signals received by said first and second signal receiving means, said analog shift registers respectively forming closed loops to shift signals in successive cycles, the bits in the first analog shift register and that in the second analog shift register being offset relative to each other;

comparison means for comparing image signals retained by the analog shift registers for every corresponding bit of said registers and producing a comparison value as an output;

one of said register including step means for shifting the signals in the bits of the shift registers relative to each other, said step means functioning every time the comparison means compares one cycle in the loop of the shift registers;

adder means for adding output of the comparison means, wherein the addition by said adder means is made for each loop of the shift registers; and minimum value detecting means for detecting the minimum value of the adder means.

7. A device according to claim 6, in which the operating means contains shifting means for shifting relationships between the above-mentioned corresponding bits.

8. A device according to claim 7, in which the comparison means contains a difference detection circuit arranged to detect a difference between the corresponding bits.

9. A device according to claim 7, in which the comparison means contains a differential circuit arranged to detect a difference between the corresponding bits.

10. A device according to claim 8 or claim 9, in which the adder means contains an analog register or registers.

11. A device according to claim 10, in which the analog shift registers are made of CCD or CCD's.

12. A device according to claim 11, in which one of the signal receiving means and the analog shift register which retains the image signals from said signal receiving means are made of one CCD.

13. A correlation detecting device for detecting a correlation of an image, comprising:

a pair of signal receiving means to receive image signals;

a first analog shift register with a plurality of bits to retain the image signals received by one of the pair of signal receiving means, said first analog shift register forming a closed loop and circulating the image signals within the closed loop while shifting said image signals between each bit;

a second analog shift register with a plurality of bits arranged to retain the image signals received by the other one of the pair of signal receiving means, said second analog shift register forming a closed loop and circulating said image signals within the closed loop while shifting said image signals between bits, the bits in the second analog shift register being offset relative to the first analog shift register;

difference detecting means for detecting in turn a difference of image signals between prescribed bits in the first and second analog shift registers;

one of said shift registers having step means for shifting the bits of the shift registers relative to each other by one bit during each cycle of circulation within the loop of the first analog shift register;

adder means for operating a sum of outputs of the difference detection means during one cycle of circulation within the first analog shift register and successively registering sums of addition;

minimum value detection means for detecting the minimum value of outputs of the adder means; and correlation detecting means for detecting a correlation of the image signals based on the minimum value obtained from the minimum value detecting means and a register address of the adder means at which said minimum value has been registered.

14. A device according to claim 13, in which the correlation detecting means contains counter means for counting numbers of circulations of the image signals within the first analog shift register until the minimum value detection means detects the above-mentioned minimum value.

15. A device according to claim 14, in which the operating means is so made that corresponding relationship of the image signals is made to deviate one bit by one bit.

16. A device according to claim 15, in which the adder means contains an analog register or analog registers.

17. A device according to claim 16, in which the first and second analog shift registers are made of CCD's.

18. A device according to claim 17, in which the signal receiving means and the analog shift registers are integrally made of a CCD.

* * * * *